US008502616B2

(12) United States Patent
Kato

(10) Patent No.: US 8,502,616 B2
(45) Date of Patent: Aug. 6, 2013

(54) COMPOSITE ELECTRONIC MODULE

(71) Applicant: Murata Manufacturing Co., Ltd., Nagaokakyo (JP)

(72) Inventor: Takatoshi Kato, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 13/771,306

(22) Filed: Feb. 20, 2013

(65) Prior Publication Data

US 2013/0154757 A1 Jun. 20, 2013

Related U.S. Application Data

(63) Continuation of application No. PCT/JP2011/005045, filed on Sep. 8, 2011.

(30) Foreign Application Priority Data

Sep. 15, 2010 (JP) ..... 2010-206475

(51) Int. Cl.
*H01P 1/32* (2006.01)

(52) U.S. Cl.
USPC ..... 333/1.1; 333/24.2

(58) Field of Classification Search
USPC ..... 333/1.1, 24.2
See application file for complete search history.

(56) References Cited

U.S. PATENT DOCUMENTS

| | | | |
|---|---|---|---|
| 2008/0218289 | A1 | 9/2008 | Wada |
| 2009/0206943 | A1 | 8/2009 | Kawanami et al. |

FOREIGN PATENT DOCUMENTS

| | | | |
|---|---|---|---|
| JP | 2003-17904 | A | 1/2003 |
| JP | 2006-135450 | A | 5/2006 |
| JP | 2006-311455 | A | 11/2006 |
| JP | 2007-208943 | A | 8/2007 |
| JP | 2008-154201 | A | 7/2008 |
| JP | 2009-49879 | A | 3/2009 |
| JP | 2010-183130 | A | 8/2010 |
| WO | 2008/087788 | A1 | 7/2008 |
| WO | 2009/001664 | A1 | 12/2008 |

OTHER PUBLICATIONS

Official Communication issued in International Patent Application No. PCT/JP2011/005045, mailed on Dec. 13, 2011.

*Primary Examiner* — Stephen Jones
(74) *Attorney, Agent, or Firm* — Keating & Bennett, LLP

(57) ABSTRACT

In a composite electronic module, electronic components including magnetic substances are mounted on a substrate such that lines of magnetic force generated by a permanent magnet of a non-reciprocal circuit element are concentrated to the non-reciprocal circuit element side. Therefore, even when a metal yoke is omitted, for example, it is possible to reduce the number of lines of magnetic force generated by the permanent magnet and which leak to the outside of the substrate, and hence to significantly reduce and prevent the influence of a magnetic field generated by the permanent magnet upon other electronic components that are arranged near or adjacent to the composite electronic module around the substrate.

20 Claims, 4 Drawing Sheets

| DISTANCE IN X-DIRECTION | RESULT | DETERMINATION |
|---|---|---|
| 0. 3 | 5/5 | × |
| 0. 7 | 5/5 | × |
| 1. 1 | 4/5 | × |
| 1. 3 | 0/5 | ○ |
| 1. 5 | 0/5 | ○ |

FIG. 4
| DISTANCE IN Y-DIRECTION | RESULT | DETERMINATION |
|---|---|---|
| 0. 3 | 5/5 | × |
| 0. 7 | 5/5 | × |
| 0. 9 | 0/5 | ○ |
| 1. 1 | 0/5 | ○ |
| 1. 5 | 0/5 | ○ |
FIG. 5
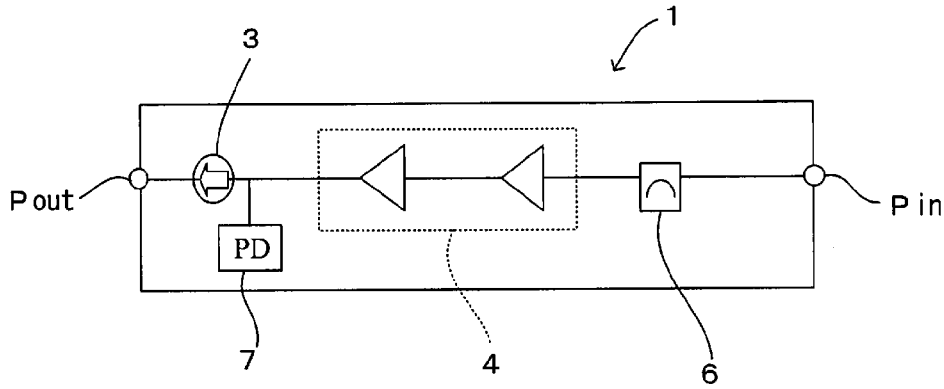
FIG. 6
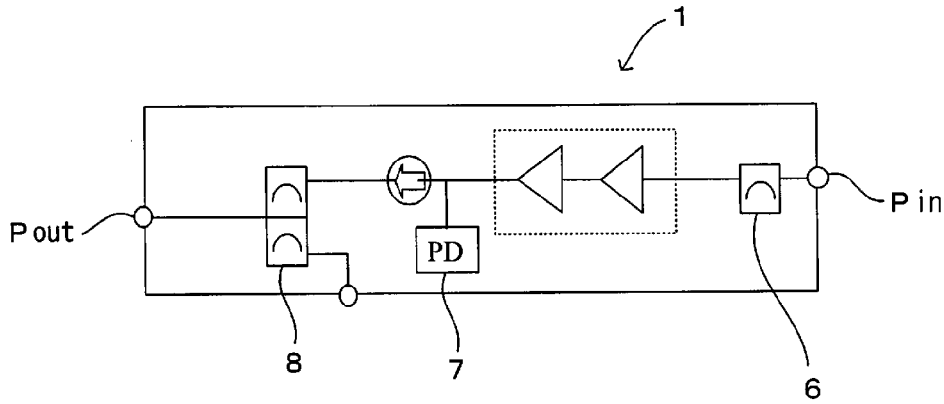

COMPOSITE ELECTRONIC MODULE

BACKGROUND OF THE INVENTION

1. Field of the Invention

The present invention relates to a composite electronic module in which a non-reciprocal circuit element is mounted on a substrate.

2. Description of the Related Art

Hitherto, a non-reciprocal circuit element, e.g., an isolator or a circulator, has been used in a composite electronic module, e.g., a power amplification module in a transmitting circuit section of a communication terminal, such as a cellular phone and a wireless LAN device, by utilizing a characteristic of the non-reciprocal circuit element to transmit a signal in a predetermined particular direction. As illustrated in FIGS. 7A and 7B, for example, a non-reciprocal circuit element 500 mounted on a substrate and forming the above-mentioned type of composite electronic module is formed in such a state that a ferrite 505 is sandwiched between a pair of permanent magnets 501 each having a rectangular parallelepiped shape and including center electrodes 503 and 504, which are formed on a principal surface 502 thereof and which are electrically insulated from each other (see, for example, Japanese Unexamined Patent Application Publication No. 2006-311455, Japanese Unexamined Patent Application Publication No. 2007-208943, and Japanese Unexamined Patent Application Publication No. 2009-49879).

Furthermore, the ferrite 505 has a rectangular parallelepiped shape and includes relay electrodes 506 that are formed in an upper end surface and a lower end surface thereof for electrical connection to the center electrodes 503 and 504 formed in the permanent magnets 501. By forming the non-reciprocal circuit element 500 as described above, manufacturing can be facilitated and an element size can be reduced in comparison with a related-art non-reciprocal circuit element having a structure in which a ferrite including copper wires wound around the ferrite is disposed as a center electrode between a pair of permanent magnets. In order to suppress the influence of a magnetic field formed by the permanent magnets 501 upon other electronic components mounted on a mother board, the non-reciprocal circuit element 500 is mounted on the substrate together with a metal yoke, which functions as an electromagnetic shield, thereby forming various types of composite electronic modules. It is to be noted that FIGS. 7A and 7B illustrate one example of the related-art non-reciprocal circuit element 500; specifically, FIG. 7A is an exploded perspective view of the non-reciprocal circuit element 500, and FIG. 7B is a perspective view of the non-reciprocal circuit element 500.

Recently, various types of composite electronic modules incorporated in communication terminals have been demanded to have smaller sizes and lower heights with further reduction in size and height of the communication terminals. In order to reduce the size and the height of the composite electronic module in view of such a demand, it is conceivable to form the composite electronic module by mounting the non-reciprocal circuit element 500 on the substrate with omission of the yoke. With omission of the yoke, the smaller size and the lower height of the composite electronic module can be achieved because it is not necessary to secure a space for mounting the yoke on the substrate.

In that case, however, since the yoke functioning as the electromagnetic shield is not mounted on the substrate, the number of lines of magnetic force generated by the permanent magnets 501 and leaking to the outside of the substrate forming the composite electronic module increases. Accordingly, the influence of the magnetic field formed by the permanent magnets 501 increases outside the substrate of the composite electronic module. For example, when the composite electronic module in which the yoke is omitted as described above is mounted to, e.g., a mother board, there is a possibility that other electronic components mounted in the surrounding area of the composite electronic module on the mother board may be moved to shift from the desired position by the magnetic force of the permanent magnets 501. For that reason, a countermeasure for preventing such a position shift is required.

SUMMARY OF THE INVENTION

In consideration of the above-described problems, preferred embodiments of the present invention provide a composite electronic module, which reduces the size and the height of the module, and which significantly reduces and prevents the influence of a magnetic field of a permanent magnet upon other electronic components mounted nearby.

A composite electronic module according to a preferred embodiment of the present invention includes a non-reciprocal circuit element including a permanent magnet, a ferrite, and an electrode pattern, electronic components including magnetic substances, and a substrate on which the non-reciprocal circuit element and the electronic components are mounted, wherein the electronic components are mounted on the substrate such that lines of magnetic force generated by the permanent magnet are concentrated to the non-reciprocal circuit element side.

Preferably, the non-reciprocal circuit element includes a pair of the permanent magnet, and the ferrite is disposed between one magnetic pole of one of the pair of permanent magnets and an opposite magnetic pole of the other of the pair of permanent magnets.

Preferably, one or more of the electronic components and the non-reciprocal circuit element are arranged nearby or adjacent to each other in a direction in which the respective magnetic poles of the permanent magnets are arrayed side by side.

Preferably, one or more of the electronic components and the non-reciprocal circuit element are arranged nearby or adjacent to each other in a direction perpendicular or substantially perpendicular to the direction in which the respective magnetic poles of the permanent magnets are arrayed side by side.

Preferably, spacings between the permanent magnets and the electronic components arranged near or adjacent to the magnetic poles of the permanent magnets in the direction in which the magnetic poles of the permanent magnets are arrayed side by side are narrower than spacings between the permanent magnets and the electronic components arranged nearby or adjacent to each other in the direction perpendicular or substantially perpendicular to the direction in which the magnetic poles of the permanent magnets are arrayed side by side.

Preferably, the electronic components are arranged such that lengthwise directions of the electronic components are parallel or substantially parallel to paths of the lines of magnetic force generated by the permanent magnet.

Preferably, a distance between the non-reciprocal circuit element and an edge of the substrate in the direction in which the respective magnetic poles of the permanent magnets are arrayed side by side is set to be about 1.2 mm or more.

Preferably, a distance between the non-reciprocal circuit element and an edge of the substrate in the direction perpendicular or substantially perpendicular to the direction in which the respective magnetic poles of the permanent magnets are arrayed side by side is set to be about 0.8 mm or more.

According to a preferred embodiment of the present invention, the electronic components including the magnetic substances are mounted on the substrate such that the lines of magnetic force generated by the permanent magnet of the non-reciprocal circuit element, which includes the permanent magnet, the ferrite, and the electrode patterns, are concentrated to the non-reciprocal circuit element side. Therefore, even when a metal yoke is omitted, for example, it is possible to reduce the number of the lines of magnetic force, which are generated by the permanent magnet and which leak to the outside of the substrate, and hence to significantly reduce and prevent the influence of a magnetic field generated by the permanent magnet upon other electronic components that are arranged near or adjacent to the composite electronic module around the substrate.

Furthermore, since the influence of the magnetic field generated by the permanent magnet upon the outside of the substrate of the composite electronic module is significantly reduced and prevented without mounting a metal yoke or the like on the substrate, there is no necessity of ensuring, on the substrate, a space for mounting a member, e.g., the yoke, which functions as an electromagnetic shield. Hence, the size and the height of the composite electronic module can be reduced.

According to another preferred embodiment of the present invention, since the non-reciprocal circuit element is provided by disposing the ferrite between the one magnetic pole of the one permanent magnet and the opposite magnetic pole of the other permanent magnet, the non-reciprocal circuit element has a practically-useful structure.

According to a further preferred embodiment of the present invention, since one or more of the electronic components and the non-reciprocal circuit element are arranged nearby or adjacent to each other in the direction in which the respective magnetic poles of the permanent magnets are arrayed side by side such that the electronic components including the magnetic substances are positioned in regions near or adjacent to the magnetic poles of the permanent magnets where a strong magnetic field is generated, the electronic components define portions of magnetic paths, and the lines of magnetic force near or adjacent to those magnetic poles of the permanent magnets are concentrated to the non-reciprocal circuit element side. Accordingly, it is possible to effectively reduce the number of the lines of magnetic force, which are generated by the permanent magnets and which leak to the outside of the substrate, and hence to more effectively reduce and prevent the influence of the magnetic field generated by the permanent magnets upon other electronic components that are arranged around the substrate.

According to yet another preferred embodiment of the present invention, since one or more of the electronic components and the non-reciprocal circuit element are arranged nearby or adjacent to each other in the direction perpendicular or substantially perpendicular to the direction in which the respective magnetic poles of the permanent magnets are arrayed side by side, the electronic components including the magnetic substances define portions of the magnetic paths, and the lines of magnetic force emanating from the one magnetic pole to the opposite magnetic pole of the permanent magnets are concentrated to the non-reciprocal circuit element side. Accordingly, it is possible to effectively reduce the number of the lines of magnetic force, which are generated by the permanent magnets and which leak to the outside of the substrate, and hence to more effectively reduce and prevent the influence of the magnetic field generated by the permanent magnets upon other electronic components that are arranged around the substrate.

According to an additional preferred embodiment of the present invention, the spacings between the permanent magnets and the electronic components arranged near or adjacent to the magnetic poles of the permanent magnets in the direction in which the magnetic poles of the permanent magnets are arrayed side by side are narrower than the spacings between the permanent magnets and the electronic components arranged nearby or adjacent to each other in the direction perpendicular or substantially perpendicular to the direction in which the magnetic poles of the permanent magnets are arrayed side by side such that the electronic components are arranged in regions near or adjacent to the magnetic poles of the permanent magnets in the direction in which the magnetic poles are arrayed side by side, where the lines of magnetic force are most concentrated and the intensity of the magnetic field is most increased. Accordingly, spreading of the magnetic field is reduced and prevented more effectively, and the magnetic field can be concentrated to the non-reciprocal circuit element side.

In addition, the electronic components are preferably arranged such that the lengthwise directions of the electronic components are parallel or substantially parallel to paths of the lines of magnetic force generated by the permanent magnets. With the lengthwise directions of the electronic components being parallel or substantially parallel to paths of the lines of magnetic force, the lines of magnetic force can more effectively be concentrated on the electronic components, and the lines of magnetic force can be concentrated to the non-reciprocal circuit element side.

According to additional preferred embodiments of the present invention, since the distance between the non-reciprocal circuit element and the edge of the substrate in the direction in which the respective magnetic poles of the permanent magnets are arrayed side by side is set to be about 1.2 mm or more and the distance between the non-reciprocal circuit element and the edge of the substrate in the direction perpendicular or substantially perpendicular to the direction in which the respective magnetic poles of the permanent magnets are arrayed side by side is set to be about 0.8 mm or more, it is possible to more effectively reduce and prevent the influence of the magnetic field generated by the permanent magnets upon electronic components that are arranged around the substrate.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 4 is a table representing one example of experimental results obtained by examining the influence of a magnetic field generated by the permanent magnets depending on positions where the electronic components are arranged.

FIG. 5 is a circuit block diagram of the composite electronic module.

FIG. 6 is a circuit block diagram of the composite electronic module.

DETAILED DESCRIPTION OF THE PREFERRED EMBODIMENTS

Figure 1A:
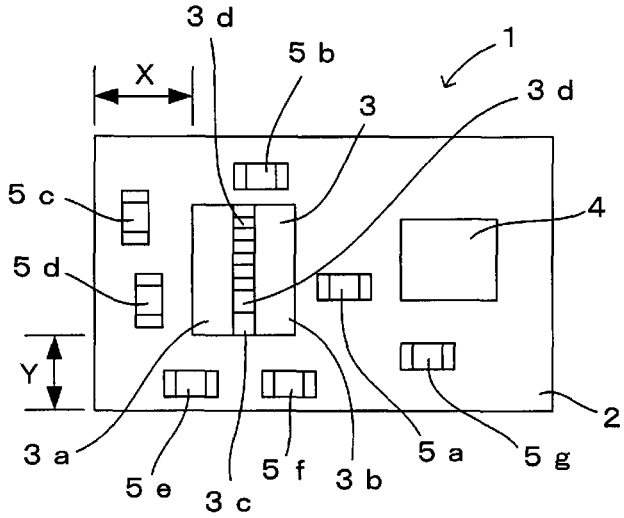
FIGS. 1A and 1B illustrate a composite electronic module according to a preferred embodiment of the present invention.
Figure 1B:
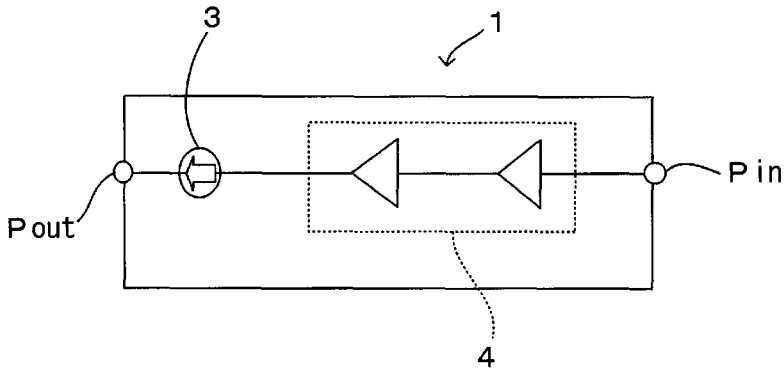
Figures 2, 3:
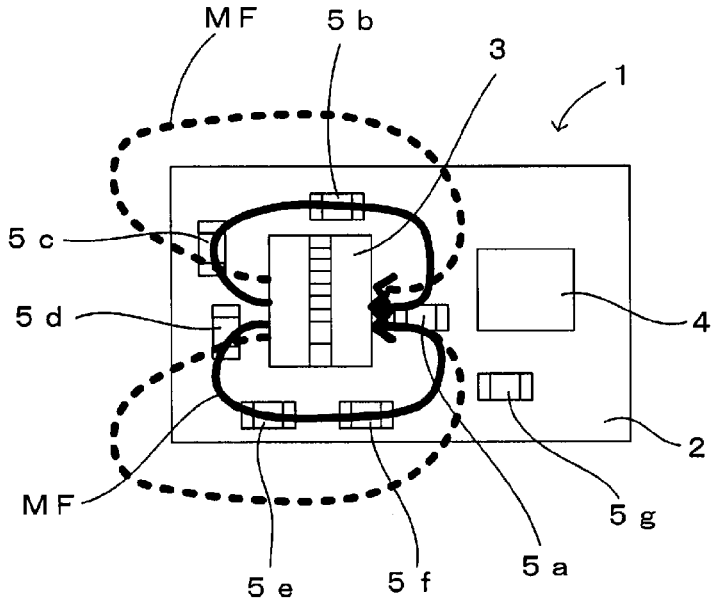
FIG. 2 is an illustration to explain the fact that lines of magnetic force generated by permanent magnets are concentrated to a non-reciprocal circuit element with proper arrangement of electronic components on a substrate side.
FIG. 3 is a table representing one example of experimental results obtained by examining the influence of a magnetic field generated by the permanent magnets depending on positions where the electronic components are arranged.
Figure 7A:
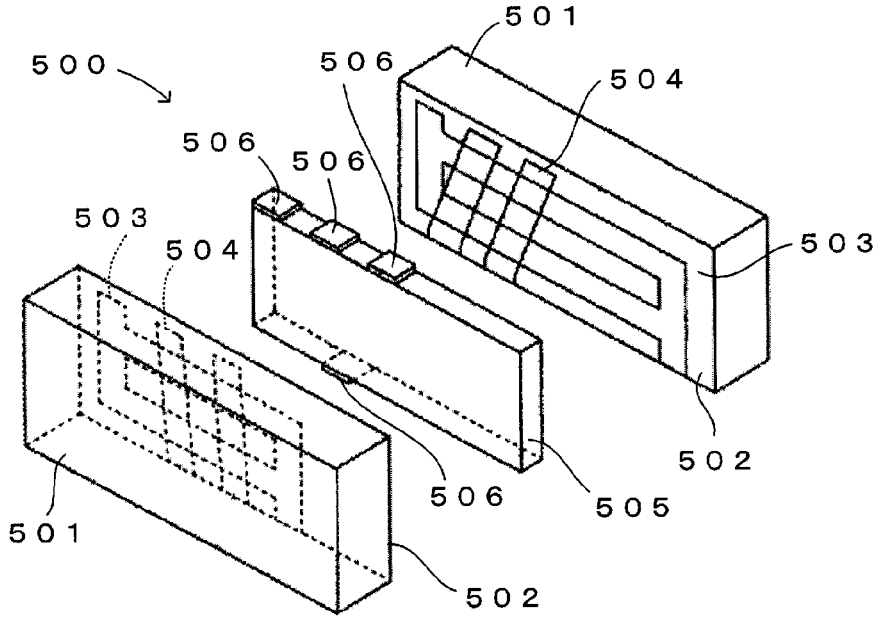
FIG. 7A Prior Art
FIGS. 7A and 7B illustrate one example of a non-reciprocal circuit element of related art.
Figure 7B:
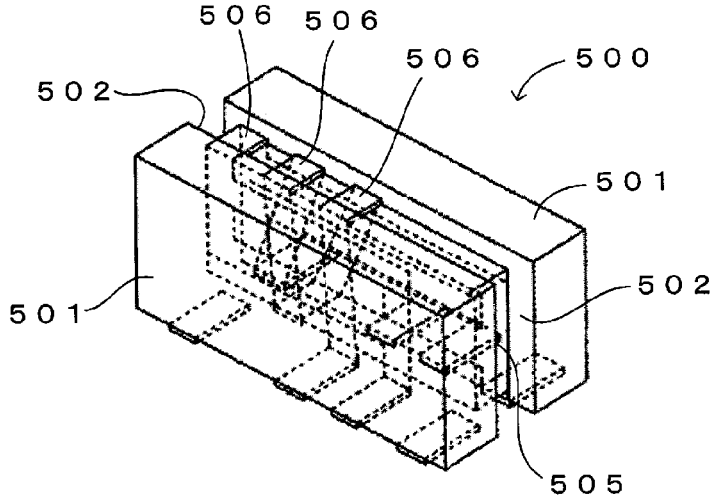
FIG. 7B Prior Art

A composite electronic module according to a preferred embodiment of the present invention will be described below with reference to FIGS. 1A to 4. FIGS. 1A and 1B illustrate a composite electronic module 1 according to a preferred embodiment of the present invention. Specifically, FIG. 1A is a layout plan, and FIG. 1B is a circuit block diagram. FIG. 2 is an illustration to explain the fact that lines of magnetic force generated by permanent magnets are concentrated in regions closer to a non-reciprocal circuit element with proper arrangement of electronic components on a substrate. FIGS. 3 and 4 are each a table representing one example of experimental results obtained by examining the influence of a magnetic field generated by the permanent magnets depending on layout positions of the electronic components.

The composite electronic module 1 illustrated in FIGS. 1A and 1B is a power amplification module that is formed by mounting, on a substrate 2 made of, e.g., resin or ceramic, a non-reciprocal circuit element 3 including an isolator having a characteristic to transmit a signal only in a predetermined particular direction, a power amplifier 4 that amplifies the transmission signal, various types of electronic components 5*a* to 5*g*, and so on. The composite electronic module 1 is preferably used in a transmitting circuit section of a communication terminal, such as a cellular phone and a wireless LAN device that is in conformity with the wireless LAN standards or Bluetooth (registered trademark) standards, for example.

As the substrate 2, a multilayered substrate obtained by firing a laminate of plural ceramic green sheets on which predetermined electrode patterns are located, a multilayered resin substrate, or the like is optionally used depending on the intended application. The substrate 2 used here may include electronic components, such as capacitors and coils, depending on the intended application of the composite electronic module 1.

The non-reciprocal circuit element 3 includes a pair of permanent magnets 3*a* and 3*b* and a ferrite 3*c*. The non-reciprocal circuit element 3 is arranged such that the ferrite 3*c* is disposed between one magnetic pole of one 3*a* of the paired permanent magnets and an opposite magnetic pole of the other permanent magnet 3*b*. In more detail, the permanent magnets 3*a* and 3*b* and the ferrite 3*c* each preferably have a rectangular or substantially rectangular parallelepiped shape. The permanent magnets 3*a* and 3*b* and the ferrite 3*c* are joined together in such a state that a magnetic field generated by the permanent magnets 3*a* and 3*b* is applied to principal surfaces of the ferrite 3 in a perpendicular or substantially perpendicular direction. Furthermore, electrode patterns 3*d* defining and serving as center electrodes are located on the principal surface of the one permanent magnet 3*a* at the side corresponding to one magnetic pole thereof, on the principal surface of the other permanent magnet 3*b* at the side corresponding to the opposite magnetic pole thereof, and on upper and lower end surfaces of the ferrite 3*c*. When the permanent magnets 3*a* and 3*b* and the ferrite 3*c* are joined together, the electrode patterns 3*d* are disposed in winding relation to the ferrite 3*c*. Electric characteristics, such as input impedance and insertion loss, of the non-reciprocal circuit element 3 can be controlled by properly adjusting a winding condition of the electrode patterns 3*d* over the ferrite 3*c*.

The electrode patterns 3*d* located on the principal surfaces of the permanent magnets 3*a* and 3*b* are each preferably a thin film preferably formed by printing or transfer using an electrode film material made of silver, copper, gold or an alloy of any of the former elements, or another type of electrode film material such as a conductor composite material (paste or adhesive) made of conductor powder of, e.g., gold or silver, an epoxy resin, etc., for example. Alternatively, the electrode patterns 3*d* may be formed in predetermined shapes on the principal surfaces of the permanent magnets 3*a* and 3*b* by a processing technique, such as photolithography or etching, using a mixture of the above-mentioned electrode film material and a photosensitive substance, for example.

The electrode patterns 3*d* located on the upper and lower end surfaces of the ferrite 3*c* are preferably used as relay electrodes to relay the electrode patterns 3*d* located on the principal surfaces of the permanent magnets 3*a* and 3*b*, and further used as connection electrodes to connect the non-reciprocal circuit element 3 to the substrate 2. Those electrode patterns 3*d* are each preferably formed as a thick film by printing or transfer using an electrode film material made of silver, copper, gold or an alloy of any of the former elements, or another type of electrode film material such as a conductor composite material (paste or adhesive) made of conductor powder of, e.g., gold or silver, an epoxy resin, etc., for example. Alternatively, those electrode patterns 3*d* may be formed in predetermined shapes on the upper and lower end surfaces of the ferrite 3*c* by a processing technique, such as photolithography or etching, using a mixture of the above-mentioned electrode film material and a photosensitive substance, for example.

The permanent magnets 3*a* and 3*b* each may be a magnet formed using any suitable material, such as a strontium-based ferrite magnet which is superior in not only magnetic characteristics, e.g., residual magnetic flux density and coercive force, but also insulation (low loss) in a high-frequency band, and a lanthanum cobalt-based ferrite magnet which is superior in magnetic characteristics, e.g., residual magnetic flux density and coercive force, which is suitable for size reduction, and which is usable even in the case requiring insulation in a high-frequency band, for example.

Moreover, as illustrated in FIGS. 1A and 1B, the non-reciprocal circuit element 3 is disposed on the substrate 2 at such a position that a distance X from an edge of the substrate 2 to the non-reciprocal circuit element 3 in a direction in which the respective magnetic poles of the permanent magnets 3*a* and 3*b* are arrayed side by side is about 1.2 mm or more, and at such a position that a distance Y from an edge of the substrate 2 to the non-reciprocal circuit element 3 in a direction perpendicular or substantially perpendicular to the direction in which the respective magnetic poles of the permanent magnets 3*a* and 3*b* are arrayed side by side is about 0.8 mm or more.

The power amplifier 4 has the function of amplifying the transmission signal. Depending on the intended application of the composite electronic module 1, the power amplifier 4 may have various circuit configurations, such as a configuration with the function of amplifying the transmission signal in a high-frequency band.

The electronic components 5*a* to 5*g* are mounted on the substrate 2 as components properly selected from among a chip capacitor, a chip coil or inductor, a chip resistor, etc. in order to form various circuits, including a matching circuit, which are preferably included in the composite electronic module 1. In the present preferred embodiment, the electronic components 5*a* to 5*f* including magnetic substances, e.g., Fe, Co and Ni, in their outer electrodes and/or their inner electrode patterns, for example, are mounted on the substrate 2 such that lines of magnetic force MF generated by the permanent magnets 3*a* and 3*b* of the non-reciprocal circuit element 3 are concentrated to the non-reciprocal circuit element 3 side.

In more detail, the electronic components 5*a*, 5*c* and 5*d* are mounted on the substrate 2 at positions near or adjacent to the non-reciprocal circuit element 3 in the direction in which the respective magnetic poles of the permanent magnets 3*a* and 3*b* are arrayed side by side, and the electronic components 5*b*, 5*e* and 5*f* are mounted on the substrate 2 at positions near or adjacent to opposite sides of the ferrite 3*c* of the non-reciprocal circuit element 3 where corresponding lateral surfaces of the ferrite 3*c* are exposed, i.e., in the direction perpendicular or substantially perpendicular to the direction in which the respective magnetic poles of the permanent magnets 3*a* and 3*b* are arrayed side by side.

Furthermore, the electronic components 5*a*, 5*b* and 5*d* to 5*f* are arranged on the substrate 2 such that spacings between the permanent magnets 3*a*, 3*b* and the electronic components 5*d*, 5*a* arranged near or adjacent to the corresponding magnetic poles of the permanent magnets 3*a* and 3*b* in the direction in which those magnetic poles are arrayed side by side are narrower than spacings between the permanent magnets 3*a*, 3*b* and the electronic components 5*b*, 5*e*, 5*f* arranged nearby or adjacent to in the direction perpendicular or substantially perpendicular to the direction in which the magnetic poles of the permanent magnets 3*a* and 3*b* are arrayed side by side.

Moreover, the electronic components 5*b*, 5*e* and 5*f* are arranged such that lengthwise directions of the electronic components 5*b*, 5*e* and 5*f* are parallel or substantially parallel to paths of the lines of magnetic force MF generated by the permanent magnets 3*a* and 3*b*. Stated another way, as illustrated in FIG. 2, because the lines of magnetic force MF generated by the permanent magnets 3*a* and 3*b* are distributed near or adjacent to short sides of the non-reciprocal circuit element 3 parallel or substantially parallel to those short sides, the electronic components 5*b*, 5*e* and 5*f* are arranged with their lengthwise directions being parallel or substantially parallel to the direction in which the respective magnetic poles of the permanent magnets 3*a* and 3*b* are arrayed side by side.

In the composite electronic module 1 according to the present preferred embodiment, as illustrated in FIG. 1B, the transmission signal input through an input port Pin is amplified by the power amplifier 4, and the amplified transmission signal is output from an output port Pout through the non-reciprocal circuit element 3. It is to be noted that only the function of the composite electronic module 1 is illustrated in FIG. 1B and the circuit configuration, including the matching circuit, etc. is omitted.

As denoted by dotted-line arrows in FIG. 2, when the non-reciprocal circuit element 3 is mounted on the substrate 2, the lines of magnetic force MF generated by the permanent magnets 3*a* and 3*b* are arranged to extend from the magnetic pole of the one permanent magnet 3*a* to the magnetic pole of the other permanent magnet 3*b* in a state where a large amount of the lines of magnetic force MF leak to the outside of the substrate 2. On the other hand, the electronic components 5*a* to 5*f* including the magnetic substances can define and serve as portions of magnetic paths of the lines of magnetic force MF. Thus, since the electronic components 5*a* to 5*f* including the magnetic substances are arranged around the non-reciprocal circuit element 3 and the electronic components 5*a* to 5*f* define and serve as portions of the magnetic paths of the lines of magnetic force MF, the lines of magnetic force MF generated by the permanent magnets 3*a* and 3*b* are concentrated to the non-reciprocal circuit element 3 side, as denoted by solid-line arrows in FIG. 2. Therefore, the number of the lines of magnetic force MF, which are generated by the permanent magnets 3*a* and 3*b* and which leak to the outside of the substrate 2 of the composite electronic module 1, is effectively reduced.

Experiments were conducted on condition that an electronic component, e.g., a chip capacitor, a chip coil or inductor, or a chip resistor, including the above-mentioned magnetic substance, e.g., Ni, in its outer electrode, etc., was repeatedly placed five times at each of different positions at each distance X from the edge of the substrate 2 to the non-reciprocal circuit element 3 in the direction in which the respective magnetic poles of the permanent magnets 3*a* and 3*b* were arrayed side by side. FIG. 3 indicates the number of times the electronic component was moved, tilted, or rotated by the magnetic force attributable to the magnetic field generated by the permanent magnets 3*a* and 3*b*.

As seen from FIG. 3, it is understood that, when the electronic component is placed at the position where the distance X from the edge of the substrate 2 to the non-reciprocal circuit element 3 is about 1.1 mm or less, almost all of the electronic components are moved, tilted, or rotated under the influence of the magnetic field generated by the permanent magnets 3*a* and 3*b*. On the other hand, it is also understood that, when the electronic component is placed at the position where the distance X from the edge of the substrate 2 to the non-reciprocal circuit element 3 is about 1.3 mm or more, all of the electronic components are not moved, tilted, or rotated because of a less influence of the magnetic field generated by the permanent magnets 3*a* and 3*b*.

Other experiments were conducted on condition that an electronic component, e.g., a chip capacitor, a chip coil or inductor, or a chip resistor, including the above-mentioned magnetic substance, e.g., Ni, in its outer electrode, etc., was repeatedly placed five times at each of different positions at each distance Y from the edge of the substrate 2 to the non-reciprocal circuit element 3 in the direction perpendicular or substantially perpendicular to the direction in which the respective magnetic poles of the permanent magnets 3*a* and 3*b* were arrayed. FIG. 4 indicates the number of times the electronic component was moved, tilted, or rotated by the magnetic force attributable to the magnetic field generated by the permanent magnets 3*a* and 3*b*.

As seen from FIG. 4, it is understood that, when the electronic component is placed at the position where the distance Y from the edge of the substrate 2 to the non-reciprocal circuit element 3 is about 0.7 mm or less, almost all of the electronic components are moved, tilted, or rotated because of a significant influence of the magnetic field generated by the permanent magnets 3*a* and 3*b*. On the other hand, it is also understood that, when the electronic component is placed at the position where the distance Y from the edge of the substrate 2 to the non-reciprocal circuit element 3 is about 0.9 mm or more, all of the electronic components are not moved, tilted, or rotated because of a less influence of the magnetic field generated by the permanent magnets 3*a* and 3*b*.

Accordingly, when the composite electronic module 1 and other electronic components are mounted on, e.g., a mother board together, proper spacings are ensured between the electronic components arranged around the composite electronic module 1 on the mother board and the non-reciprocal circuit element 3 included in the composite electronic module 1 by arranging the composite electronic module 1 such that the non-reciprocal circuit element 3 is mounted on the substrate 2 while the distances from the edges of the substrate 2 to the non-reciprocal circuit element 3 are properly set. As a result, the electronic components arranged around the composite electronic module 1 can be prevented from moving, tilting, or rotating and shifting from the desired positions under the influence of the magnetic field generated by the permanent magnets 3*a* and 3*b* in the non-reciprocal circuit element 3 before the electronic components are fixedly held by soldering, for example.

Thus, according to the preferred embodiment described above, the electronic components 5*a* to 5*f* including the magnetic substances are mounted on the substrate 2 such that the lines of magnetic force MF generated by the permanent magnets 3*a* and 3*b* of the non-reciprocal circuit element 3, which includes the permanent magnets 3*a* and 3*b*, the ferrite 3*c*, and the electrode patterns 3*d*, are concentrated to the non-reciprocal circuit element 3 side. Therefore, even when a metal yoke is omitted, for example, it is possible to reduce the number of the lines of magnetic force MF, which are generated by the permanent magnets 3*a* and 3*b* and which leak to the outside of the substrate 2, and hence to significantly reduce and prevent the influence of the magnetic field generated by the permanent magnets 3*a* and 3*b* upon other electronic components that are arranged near or adjacent to the composite electronic module 1 around the substrate 2.

Furthermore, since the influence of the magnetic field generated by the permanent magnets 3*a* and 3*b* upon the outside of the substrate 2 of the composite electronic module 1 can be significantly reduced and prevented without mounting the metal yoke or the like on the substrate 2, there is no necessity of ensuring, on the substrate 2, a space for mounting a member, e.g., the yoke, which functions as an electromagnetic shield. Hence, the size and the height of the composite electronic module 1 can be reduced.

Since the non-reciprocal circuit element 3 is arranged such that the ferrite 3*c* is disposed between the one magnetic pole of the one permanent magnet 3*a* and the opposite magnetic pole of the other permanent magnet 3*b*, the non-reciprocal circuit element 3 can be have a compact and practically-useful structure.

Since the electronic components 5*a*, 5*c* and 5*d* and the non-reciprocal circuit element 3 are arranged nearby or adjacent to each other in the direction in which the respective magnetic poles of the permanent magnets 3*a* and 3*b* are arrayed side by side such that the electronic components 5*a*, 5*c* and 5*d* including the magnetic substances are positioned in regions near or adjacent to the magnetic poles of the permanent magnets 3*a* and 3*b* where a strong magnetic field is generated, the electronic components 5*a*, 5*c* and 5*d* define and serve as portions of the magnetic paths, and the lines of magnetic force MF near or adjacent to the magnetic poles of the permanent magnets 3*a* and 3*b* are concentrated to the non-reciprocal circuit element 3 side. Accordingly, it is possible to effectively reduce the number of the lines of magnetic force MF, which are generated by the permanent magnets 3*a* and 3*b* and which leak to the outside of the substrate 2, and hence to more effectively reduce and prevent the influence of the magnetic field generated by the permanent magnets 3*a* and 3*b* upon other electronic components that are arranged around the substrate 2.

Since the electronic components 5*b*, 5*e* and 5*f* and the non-reciprocal circuit element 3 are arranged nearby or adjacent to each other in the direction perpendicular or substantially perpendicular to the direction in which the respective magnetic poles of the permanent magnets 3*a* and 3*b* are arrayed side by side, the electronic components 5*b*, 5*e* and 5*f* including the magnetic substances define and serve as portions of the magnetic paths, and the lines of magnetic force MF generated between the one magnetic pole and the opposite magnetic pole of the permanent magnets 3*a* and 3*b*, which are coupled to each other with the ferrite 3*c* interposed therebetween, are concentrated to the non-reciprocal circuit element 3 side. Accordingly, it is possible to effectively reduce the number of the lines of magnetic force MF, which are generated by the permanent magnets 3*a* and 3*b* and which leak to the outside of the substrate 2, and hence to significantly reduce and prevent such an adverse influence of the magnetic field generated by the permanent magnets 3*a* and 3*b* as causing position shifts of other electronic components arranged near or adjacent to the composite electronic module 1 around the substrate 2.

Moreover, the spacings between the permanent magnets 3*a*, 3*b* and the electronic components 5*d*, 5*a* arranged near or adjacent to the corresponding magnetic poles of the permanent magnets 3*a* and 3*b* in the direction in which those magnetic poles are arrayed side by side are narrower than the spacings between the permanent magnets 3*a*, 3*b* and the electronic components 5*b*, 5*e*, 5*f* arranged nearby or adjacent to in the direction perpendicular or substantially perpendicular to the direction in which the magnetic poles of the permanent magnets 3*a* and 3*b* are arrayed side by side. Thus, the electronic components 5*d*, 5*a* are arranged in regions near or adjacent to the corresponding magnetic poles of the permanent magnets 3*a* and 3*b* in the direction in which the magnetic poles of the permanent magnets 3*a* and 3*b* are arrayed side by side, where the lines of magnetic force MF are most concentrated and the intensity of the magnetic field is most increased. Accordingly, spreading of the magnetic field can be reduced and prevented more effectively, and the magnetic field can be concentrated to the non-reciprocal circuit element 3 side.

In addition, the electronic components are preferably arranged such that the lengthwise directions of the electronic components 5*b*, 5*e* and 5*f* are parallel or substantially parallel to paths of the lines of magnetic force MF generated by the permanent magnets 3*a* and 3*b*. With the lengthwise directions of the electronic components 5*b*, 5*e* and 5*f* being parallel or substantially parallel to paths of the lines of magnetic force MF, the lines of magnetic force MF can more effectively be concentrated on the electronic components 5*b*, 5*e* and 5*f*, and the lines of magnetic force MF can be concentrated to the non-reciprocal circuit element 3 side.

Since the distance between the non-reciprocal circuit element 3 and the edge of the substrate 2 in the direction in which the respective magnetic poles of the permanent magnets 3*a* and 3*b* are arrayed side by side is preferably set to be about 1.2 mm or more and the distance between the non-reciprocal circuit element 3 and the edge of the substrate 2 in the direction perpendicular or substantially perpendicular to the direction in which the respective magnetic poles of the permanent magnets 3*a* and 3*b* are arrayed side by side is preferably set to be about 0.8 mm or more, it is possible to more effectively reduce and prevent such an adverse influence of the magnetic field generated by the permanent magnets 3*a* and 3*b* that causes significant position shifts of other electronic components arranged near or adjacent to the composite electronic module 1 around the substrate 2.

When the composite electronic module 1 is mounted on, e.g., a mother board together with other electronic components, the spacing between the composite electronic module and each of the other electronic components is preferably about 0.1 mm as a mounting clearance. In the present preferred embodiment, therefore, the non-reciprocal circuit element 3 is mounted on the substrate 2 at distances shorter than the shortest distances at which the electronic components are not affected by the magnetic field of the permanent magnets 3*a* and 3*b*, described above with reference to FIGS. 3 and 4, by about 0.1 mm in each of the X- and Y-directions, for example. Stated another way, the non-reciprocal circuit element 3 may be mounted on the substrate 2 such that the distance between the non-reciprocal circuit element 3 and the edge of the substrate 2 in the direction in which the respective magnetic poles of the permanent magnets 3*a* and 3*b* are arrayed side by side is set to be about 1.3 mm or more and the distance between the non-reciprocal circuit element 3 and the edge of the substrate 2 in the direction perpendicular or substantially perpendicular to the direction in which the respective magnetic poles of the permanent magnets 3*a* and 3*b* are arrayed side by side is set to be about 0.9 mm or more, for example.

The present invention is not limited to the above-described preferred embodiments, and it can variously be modified into other forms without departing from the gist of the present invention. For example, as illustrated in FIG. 5, an inter-stage filter 6 (SAW filter) and a power detector 7 may further be included in the composite electronic module 1. In addition, as illustrated in FIG. 6, a duplexer 8 may further be included in the composite electronic module 1. Though not illustrated, a switch, a multiplexer such as a diplexer, a coupler, etc. may further be included in the composite electronic module 1. It is to be noted that FIGS. 5 and 6 are circuit block diagrams representing different examples of the composite electronic module.

The composite electronic module 1 may further include a cover made of, e.g., a non-magnetic metal or a magnetic metal, or it may be molded with resin.

The non-reciprocal circuit element 3 is not limited to the isolator having the above-described structure, and a known isolator having a different structure may also optionally be used as the non-reciprocal circuit element 3. Alternatively, the non-reciprocal circuit element 3 may be a circulator.

The layout positions where the electronic components including the magnetic substances are arranged on the substrate 2 of the composite electronic module 1 are not limited to the above-described positions. The layout positions of the electronic components on the substrate 2 may be set depending on, e.g., the layout position of the non-reciprocal circuit element 3 mounted on the substrate 2 of the composite electronic module 1 such that the lines of magnetic force MF generated by the permanent magnets 3*a* and 3*b* are effectively concentrated to the non-reciprocal circuit element 3 side.

The electronic components disposed on the substrate 2 are not limited to the above-mentioned examples, and optimum electronic components may be selected as appropriate depending on the intended application and the design of the composite electronic module 1.

Preferred embodiments of the present invention can widely be applied to composite electronic modules each including a non-reciprocal circuit element including a permanent magnet, a ferrite, and an electrode pattern, an electronic component including a magnetic substance, and a substrate on which the non-reciprocal circuit element and the electronic component are mounted.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A composite electronic module comprising:

a non-reciprocal circuit element including a permanent magnet, a ferrite, and an electrode pattern;

electronic components including magnetic substances; and a substrate on which the non-reciprocal circuit element and the electronic components are mounted; wherein the electronic components are mounted on the substrate such that lines of magnetic force generated by the permanent magnet are concentrated to a non-reciprocal circuit element side.

2. The composite electronic module according to claim 1, wherein the electronic components are arranged such that lengthwise directions of the electronic components are parallel or substantially parallel to paths of the lines of magnetic force generated by the permanent magnet.

3. The composite electronic module according to claim 1, wherein the composite electronic module is a power amplification module.

4. The composite electronic module according to claim 1, further comprising a power amplifier, wherein the non-reciprocal circuit element is an isolator arranged to transmit a signal only in one predetermined direction and the power amplifier is arranged to receive and amplify the signal received from the isolator.

5. The composite electronic module according to claim 1, wherein the substrate is a multilayer substrate including a plurality of ceramic layers include conductive patterns disposed thereon.

6. The composite electronic module according to claim 1, wherein the electronic components include at least one of a capacitor, an inductor, and a resistor.

7. The composite electronic module according to claim 1, further comprising an interstage filter and a power detector.

8. The composite electronic module according to claim 1, further comprising at least one of a duplexer, a multiplexer, and a switch.

9. The composite electronic module according to claim 1, further comprising a cover made of a magnetic material, a non-magnetic material or a resin.

10. The composite electronic module according to claim 1, wherein the non-reciprocal circuit element is an isolator or a circulator.

11. A communication terminal comprising the composite electronic module according to claim 1.

12. The composite electronic module according to claim 1, wherein the non-reciprocal element includes a pair of the permanent magnet and a plurality of the electrode pattern, and the electrode patterns are disposed on one principal side of a first of the pair of permanent magnets and one principal side of a second of the pair of permanent magnets.

13. The composite electronic module according to claim 12, wherein the electrode patterns are arranged in a winding relationship relative to the ferrite.

14. The composite electronic module according to claim 12, wherein the electrode patterns connect the non-reciprocal circuit element to the substrate.

15. The composite electronic module according to claim 1, wherein the non-reciprocal circuit element includes a pair of the permanent magnet; and the ferrite is disposed between one magnetic pole of one of the pair of permanent magnets and an opposite magnetic pole of the other of the permanent magnets.

16. The composite electronic module according to claim 15, wherein one or more of the electronic components and the non-reciprocal circuit element are arranged adjacent to each other in a direction in which the respective magnetic poles of the permanent magnets are arrayed side by side.

17. The composite electronic module according to claim 15, wherein one or more of the electronic components and the non-reciprocal circuit element are arranged adjacent to each other in a direction perpendicular or substantially perpendicular to a direction in which the respective magnetic poles of the permanent magnets are arrayed side by side.

18. The composite electronic module according to claim 15, wherein spacings between the permanent magnets and the electronic components arranged adjacent to the magnetic poles of the permanent magnets in a direction in which the magnetic poles of the permanent magnets are arrayed side by side are narrower than spacings between the permanent magnets and the electronic components arranged adjacent to each other in a direction perpendicular or substantially perpendicular to the direction in which the magnetic poles of the permanent magnets are arrayed side by side.

19. The composite electronic module according to claim 15, wherein a distance between the non-reciprocal circuit element and an edge of the substrate in a direction in which the respective magnetic poles of the permanent magnets are arrayed side by side is about 1.2 mm or more.

20. The composite electronic module according to claim 15, wherein a distance between the non-reciprocal circuit element and an edge of the substrate in a direction perpendicular or substantially perpendicular to a direction in which the respective magnetic poles of the permanent magnets are arrayed side by side is about 0.8 mm or more.

* * * * *